US005867924A

United States Patent [19]

Gattelet

[11] Patent Number: 5,867,924

[45] Date of Patent: Feb. 9, 1999

[54] SPORT BOOT HAVING A LOWER LEG SUPPORT WITH AREAS OF DIFFERING FLEXIBILITIES

[75] Inventor: Jean Gattelet, Menthon Saint Bernard, France

[73] Assignee: Salomon S.A., Cedex, France

[21] Appl. No.: 762,152

[22] Filed: Dec. 9, 1996

[30] Foreign Application Priority Data

Oct. 8, 1995 [FR] France ..... 95 15014

[51] Int. Cl.[6] ..... A43B 5/04; A43B 23/26

[52] U.S. Cl. ..... 636/119.1; 36/54

[58] Field of Search ..... 36/1, 117.1, 54, 36/119.1, 132, 136

[56] References Cited

U.S. PATENT DOCUMENTS

| | | | |
|---|---|---|---|
| 4,372,061 | 2/1983 | Pozzobon | 36/119.1 |
| 4,406,073 | 9/1983 | Spademan | 36/54 X |
| 5,381,611 | 1/1995 | Tonel et al. | 36/117.1 |

FOREIGN PATENT DOCUMENTS

| | | | |
|---|---|---|---|
| 0 074513 A1 | 3/1983 | European Pat. Off. . | |
| 0 123 636 A1 | 10/1984 | European Pat. Off. . | |
| 0 573 389 A1 | 8/1993 | European Pat. Off. . | |
| 0 623 294 A1 | 11/1994 | European Pat. Off. . | |
| 2475370 | 8/1981 | France | 36/117.1 |
| 2 506 135 | 11/1982 | France . | |
| 2 649 594 A1 | 1/1991 | France . | |
| 18 17 998 A1 | 2/1977 | Germany . | |

*Primary Examiner*—B. Dayoan

[57] ABSTRACT

Sport shoe incorporating a shell (1) joined to a sole (7) and surmounted by an upper (2) and a support plate (8) which is angularly adjustable using a fastening arrangement (9), the plate being designed to support the wearer's lower leg. The plate (8) comprises two areas (18, 19) of differing flexibilities, and the fastening arrangement (9) incorporates at least two tenon-like elements (10) with which hollow elements (1) cooperate. The fastening arrangement (9) makes it possible to adjust the plate (8) in relation to the upper (2) in at least two angular positions, in which one and/or the other of the flexible areas (18, 19) is used, and to immobilize this plate against rotation after adjustment.

9 Claims, 3 Drawing Sheets

SPORT BOOT HAVING A LOWER LEG SUPPORT WITH AREAS OF DIFFERING FLEXIBILITIES

FIELD OF THE INVENTION

The present invention relates to a sport shoe, such as a ski boot, an ice-skating boot, an in-line or conventional roller blade boot, etc., comprising an upper which encloses the lower leg of the wearer, and it concerns a support plate that adjusts over a portion of the foot-insertion perimeter of this upper so as to form a lower leg support.

BACKGROUND OF THE INVENTION

Known sports shoes of this kind are described in U.S. Pat. Nos. 3,516,180 and 4,282,659, FR 2 506 ,135, EP 74 513, and patent applications Nos. FR 2 649 594 and EP 623 294.

In these shoes, the support plates are primarily designed to distribute the forces being exerted, at the point of attachment of these plates, between the portion of the foot-insertion perimeter involved and the area opposite the lower leg of the wearer. In accordance with the various construction embodiments disclosed, these plates also make it possible to improve adjustment of the boot upper to fit the morphology of the wearer's lower leg; to reinforce the upper at discrete points, in order, for example to direct certain forces in a preferred direction; or to increase or decrease the upward extent of the support they give to the lower leg, for example in order to increase the wearer's perception of the stresses generated and, in this way, to provide the wearer with the means to react more quickly and with greater precision to certain stresses.

More precisely, with respect to the boots in U.S. Pat. Nos. 3,516,180 and 4,282,659, the support plates are independent of the boot upper, and, accordingly, the position thereof is easily adjustable on the wearer's lower leg. However, because of this autonomous arrangement, they contribute little to reinforcement of the upper and, above all, they must be adjusted to the support position selected by the wearer each time the boot is put on. Moreover, these support plates, which incorporate a one-piece undifferentiated structure and which can be mounted in only one direction, do not allow the level of support they supply to be modified as regards flexibility and stiffness in particular.

In the shoes according to FR 2 649 594, FR 2 506 135 and EP 74 513, the support plates are, in contradistinction to the shoes mentioned above, fastened adjustably in place on the upper. In this way, the wearer may pre-adjust as desired the relative position of the plate on the upper, and, therefore, the position of the support it imparts to the lower leg. On the other hand, moving the position of the plate on the upper either up or down or transversely merely adjusts the position of the support and/or reinforcement given to the upper. It does not, in fact, allow for changes in the level of flexibility and/or stiffness support it imparts to the facing area of the lower leg. More especially with regard to EP 74 513, the support plate is made flexible, but this flexibility remains constant and may not be modified or eliminated.

This problem is solved in the shoe disclosed in EP 623 294, in which, in a specific embodiment, the support plate incorporates two areas of differing flexibilities which can be utilized simply by rotating the plate 180°; however, there is no opportunity to modify the relative position of this plate in relation to the upper.

This boot incorporates a shell surmounted by an upper which, on its inner face and over a portion of its foot-insertion perimeter, incorporates a support plate comprising two areas of differing flexibilities. Using means which fasten it to the upper. this support plate is adjustable angularly between two opposite position, i.e., between 180°, each of which corresponds to the activation of one of its flexible areas. Overall, the support plate is four-sided, and the differentiated areas of flexibility are obtained by making weakening notches in one its sides. In this boot, in contradistinction to the boots previously mentioned, it is possible to modify the flexibility and/or stiffness of the support provided by the plate, by positioning one or the other of these areas so that it extends beyond the foot-insertion perimeter of the upper at the point of attachment thereof.

On the other hand, because the support plate is mounted in a rotating arrangement, and, more precisely, because it turns on the pivot-like fastening means which are fixed on the same spot on the upper, upward and lateral adjustment of the plate cannot be effected as chosen by the wearer. Furthermore, since the attachment means form a plate-rotating assembly, the plate is not held constantly and reliably in the chosen angular position. In fact, no element blocks its rotational motion, and it remains free to pivot on itself.

SUMMARY OF THE INVENTION

The present invention is intended to solve the problems inhering in the sports shoes just described, by disclosing a boot in which the support plate is pre-adjustable and can be locked in position on the upper, both vertically and/or laterally and angularly on itself, so as to produce, for each pre-adjusted position, at least two different support levels as regards flexibility, stiffness, and/or shock-absorption.

To this end, the sports boot incorporates a shell surmounted by an upper, which comprises, on its inner face and over a portion of its foot-insertion perimeter, a support plate incorporating at least two areas of differing flexibilities, this plate being adjustable angularly, using means fastening it to the upper, between two angular position, each of which corresponds to the utilization of at least flexible area, and is characterized by the fact that the support plate-fastening means are constituted by at least two tenon-like elements, with which an equal number of hollow elements, such as holes, cooperate. The support plate can thus be locked in rotation for each of its adjustment positions in relation to the upper, as regards both upward and transverse positioning, and the angular adjustment thereof is dependent on the disengagement of these tenons from the holes, then on the reinsertion of the tenons in the holes positioned in the corresponding positions.

According to one embodiment, the means used to attach the plate comprise a number of holes greater than that of the tenon-like elements, and they are spaced apart by a distance having a value "a" equal to the value "a" separating the tenons. Accordingly, the support plate can be set "hole by hole" in relation to the upper in as many positions as there are holes existing in addition to the number of tenons, and this is true in addition to its potential angular adjustment designed to give at least two different levels of support.

According to another embodiment, the means used to attach the plate comprise hollow elements constituted by oblong parallel slots and tenons formed by cylindrical parts having a diameter matching the width of these slots. The support plate may thus be "continuously" adjusted in relation to the upper, depending on the length of the oblong slots.

The oblong slots may be provided in various positions as desired in relation to the upper. Thus, for example, if one wishes to have the opportunity of continuous upward adjustment of the support plate, the oblong slots are positioned vertically. When one wishes to provide for continuous adjustment transversely to the upper, the oblong slots are positioned in the desired direction.

To ensure complete position retention of the support plate in relation to the upper, removable assembly parts such as screws, bolts, pins, etc. may incorporated into the attachment means. According to preferred embodiments, the assembly parts are screws or bolts, and the cylindrical shafts of these parts constitute the tenon-like elements.

The different areas of flexibility of the support plate are produced by cutting weakening notches in at least one of these areas. They are also produced by using at least two separate materials, one being more flexible and/or more compressible than the other. Preferably, the areas of differing flexibilities are located on either side of the means for fastening the support plate.

The boot upper equipped with the support plate may be of the collar type incorporating overlapping transverse flaps, or of the type comprising a front and a back cover.

BRIEF DESCRIPTION OF THE DRAWINGS

The following description provided with reference to the attached schematic drawings illustrates, by way of example, several embodiments of the support plate according to the invention.

DETAILED DESCRIPTION

Figure 1:
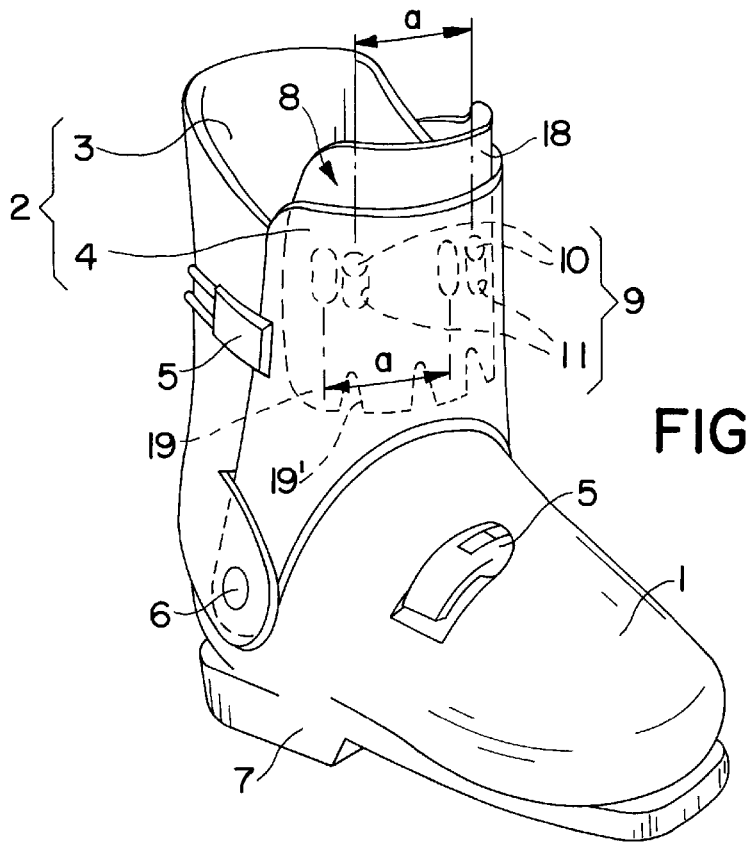
FIGS. 1 and 2 are perspective views illustrating sport boots, such as ski boots, equipped with a support plate, FIG. 1 showing a boot in which the upper comprises a front and a rear cover, and FIG. 2 showing a boot in which the upper is of the collar type with transverse closing flaps.

The boot illustrated in FIG. 1 is constituted by a shell 1 surrounding the foot and the heel, a sole 7, and an upper 2 of the type comprising a rear cover 3 and a front cover 4. Conventional closing and foot-retention elements 5 are fitted on the upper 2 and the shell 1. The front and rear covers 4 and 3 are jointed around connection pivots 6 on each side of the shell 1 in an area lined up approximately with the wearer's malleoli. In this embodiment, the support plate 8 is attached to a portion of the foot-insertion perimeter of the upper 2, for example on the inner side of the front cover 4, in order to support the front portion of the lower leg. Attachment means 9 incorporating tenons 10, which are integral with the front cover 4 and spaced apart by a distance having a value "a," cooperate with corresponding hollow elements 11. These hollow elements are constituted by oblong slots positioned vertically and spaced apart by a distance having a value "a" identical to that separating the tenons 10. The support plate 8 is thus immobilized in rotation when mounted on the tenons 10, but it retains the ability to be moved vertically because of the positioning of the oblong slots 11, this potential movement being restricted by the length of these slots. To allow lateral and/or transverse adjustment of the support plate 8 in relation to the front cover 4, and, accordingly, to the upper 2, an additional pair of oblong slots 11 is produced at a distance from, and parallel to, the first pair of slots 11. Thus, depending on the pair of slots 11 chosen to be mounted on the pair of tenons 10, the support plate 8 is substantially centered in relation to the front part of the front cover 4, and, therefore, provides substantially lateral support to the lower leg.

To allow the level of support to be adjusted, in addition to position adjustment in relation to the upper 2, the support plate 8 incorporates two areas 18 and 19 of differing flexibilities. To this end, weakening notches 19'are made only in the edge delimiting the area 19, which is thus made more flexible than area 18. In the example illustrating the mounting of the support plate 8 as shown, the most flexible area 19 extends downward beneath the front cover 4, and the least flexible area 18 extends substantially beyond the upper edge of this cover 4; that is, it extends above the foot-insertion perimeter of the upper 2. In this instance, the lower leg is held by firm support.

Figure 2:
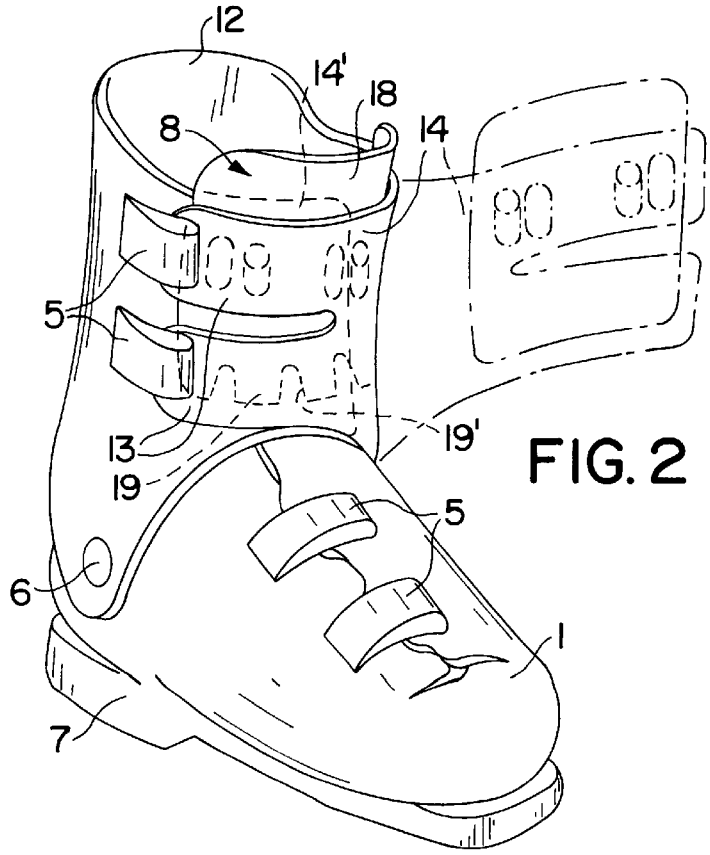

Like the ski boot in FIG. 1, the ski boot in FIG. 2 comprises a shell 1 enclosing the foot and the heel and a sole 7, but this time the collar-type upper 12 closes over its front portion by means of overlapping flaps 14 and 14'. In this embodiment, the outer flap 14 incorporates two tightening straps 13, which are fitted with, and/or undergo the action produced by, the tightening and closing elements 5. The support plate 8 is attached to the upper strap 13 using attachment means 9 similar to those previously described with respect to the boot in FIG. 1 and is thus sandwiched between the flaps 14 and 14'. By virtue of this assembly, the plate 8 is automatically positioned away from the front area of the upper 12 when the flap 14 is moved away, as shown in broken lines, in order to permit passage of the foot when the boot is taken off or put on.

However, the support plate 8 can also be fastened to the inner flap 14' in a position facing the outer flap 14, the plate 8 remaining sandwiched between the flaps; or it may extend over the flap 14' on the inside of the upper 2.

Figure 3:
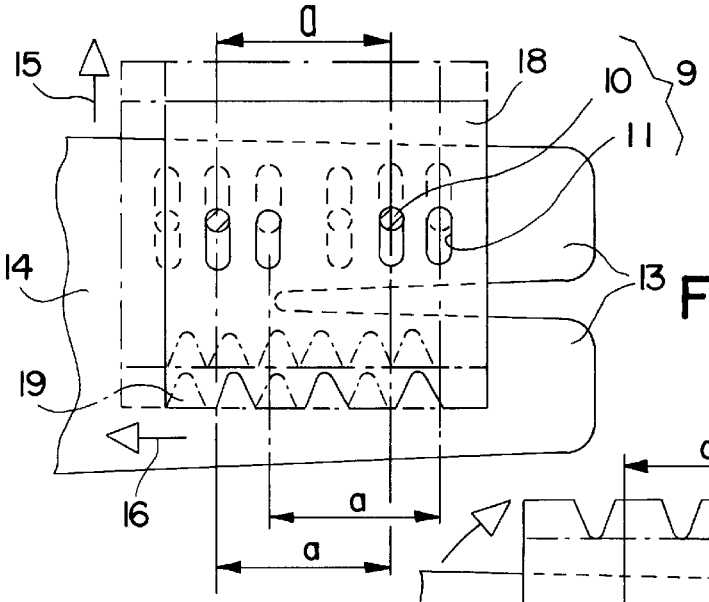
FIG. 3 is a partial view of the boot upper flap in FIG. 2, which is equipped with the support plate using attachment means arranged in accordance with an embodiment, and shows, in fine broken lines, various adjustment positions in relation to the upper.
Figure 4:
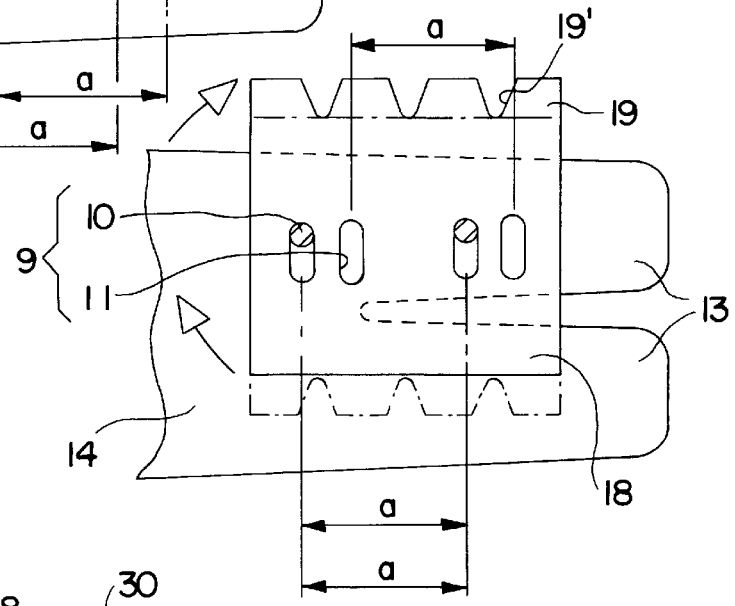
FIG. 4 illustrates the support plate in FIG. 3 in a second support-adjustment position, in which the most flexible area is activated in proximity to the foot-insertion perimeter of the upper.

FIGS. 3 and 4 illustrate the various possibilities for adjustment of the support plate 8 on the outer flap 14 of the boot upper 12. As previously explained, the fastening means constituted by the tenons 10 and slots 11 are located on the upper strap 13. The tenons 10 are spaced apart by a distance having a value "a," and the oblong slots 11 are spaced apart in pairs by a distance having a value "a" identical to that of the tenons 10. Moreover, as described with reference to FIG. 1, the support plate 8 incorporates two areas 18 and 19 of differing flexibilities, which are located on either side of the fastening means 9, and which can be utilized as desired simply by reversing the plate 8 by 180°.

Thus, for a given adjustment of the level of support achieved, by example, by placing the least flexible area 18 so that it extends beyond the upper edge of the flap 14, as shown in FIG. 3, the plate 8 can be continuously shifted and adjusted vertically in the direction shown by the arrow 15 because of the length of the slots 11, and also laterally, as shown by arrow 16, by changing the pair of slots 11 cooperating with the tenons 10.

In this embodiment incorporating two pairs of oblong slots 11, there are two lateral adjustment positions of the plate 8 in relation to the flap 14, and a multitude of vertical adjustment positions determined by the length of the slots 11, in addition to the two positions of adjustment of the level of support provided by the plate 8. It is obvious that additional pairs of oblong slots 11 can be produced if more possibilities for lateral adjusted are desired.

Of course, in FIG. 4, when the plate 8 is reversed by 180° in order to cause the most flexible area 19 to extend beyond the upper edge of the flap 14, there are also available the same possibilities for position adjustment in relation to the flap 14, and thus to the boot upper.

Figure 5:
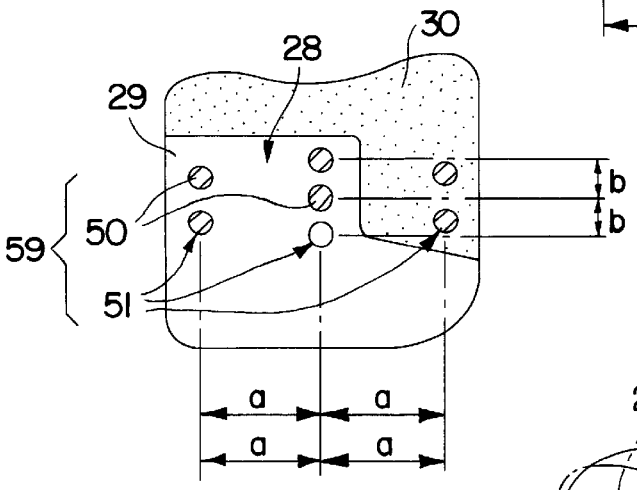
FIGS. 5 and 6 illustrate a support plate comprising two areas of differing flexibilities produced using two distinct materials and another embodiment of the means used to fasten this plate.
Figure 6:
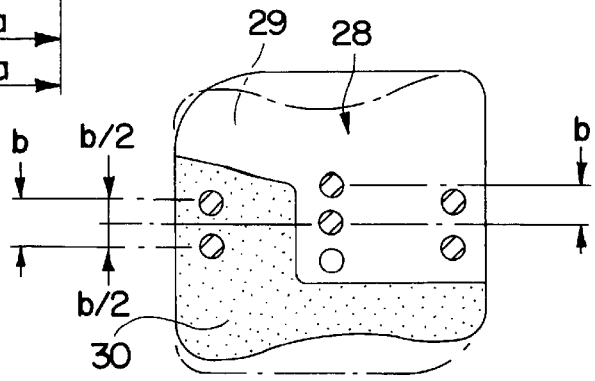

According to an embodiment of the support plate 28 illustrated in FIGS. 5 and 6, the areas 29, 30 possessing differing flexibilities are created not by making weakening notches, but by using materials having different flexibility, pliability, and/or elastic compressibility properties, among others. Furthermore, these areas 29, 30 of differing flexibilities may be arranged asymmetrically in relation to the fastening means 59 of the plate 28. As before, the fastening means 59 comprise tenon-like elements 50, which are located on the boot upper (not shown), with which hollow parts 51, formed in this case by cylindrical holes, cooperate. To this end, the tenons 50 are spaced apart horizontally by a distance having a value "a" corresponding to that of the holes 51. In this embodiment, there are six tenons arranged horizontally in three pairs, inside of which the tenons are spaced apart by a distance having a value "b," the central pair being vertically offset from the two others by a distance having a value "b/2."The holes 51 are arranged in groups of three pairs and match up with the tenons 50. To allow reversal of the support plate 28 by 180° on the tenons 50, a seventh hole 51 is added to the pair of holes 51 occupying the center position and offset vertically by a distance "b." Thus, in one or the other of the positions of adjustment of its flexible areas 29, 30, the support plate 28 continuously meshes with the six tenons 50.

Figure 7:
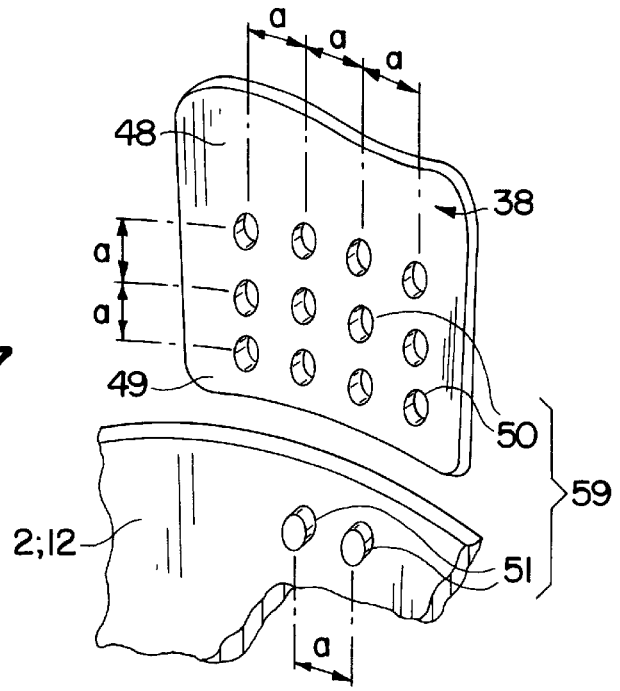
FIGS. 7, 8 and 9 illustrate different embodiments of the means for attaching the support plate and of the flexible areas thereof.
Figure 8:
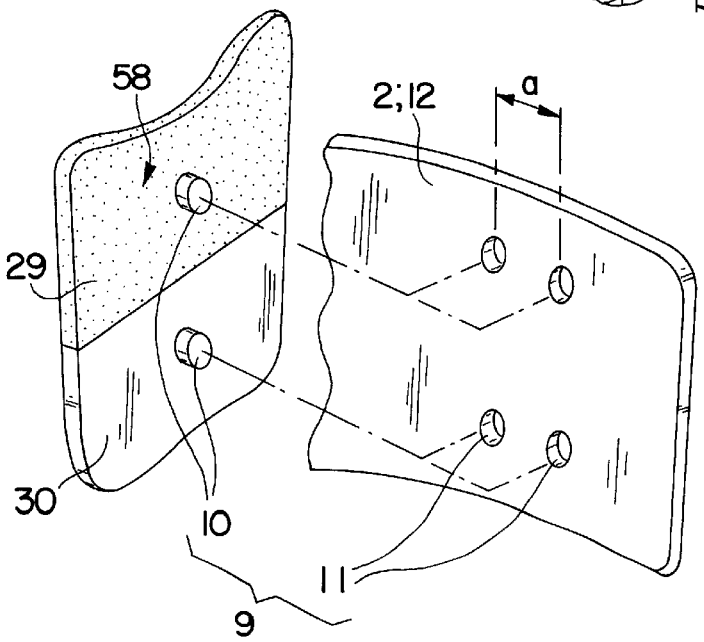
Figure 9:
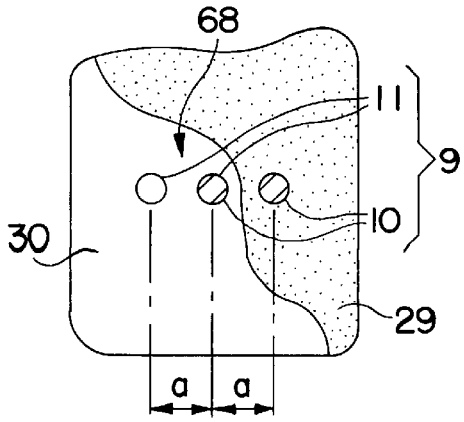

FIGS. 7, 8 and 9 illustrate variants of the means used to fasten the support plate and/or the areas of differing flexibilities thereof.

In FIG. 7, the support plate 38 is provided with fastening means constituted by a multitude of cylindrical holes 50 spaced apart by a value "a" both horizontally and vertically, and two tenons 51 spaced apart by a corresponding value "a." As before, the support plate 38 is thus adjustable laterally-transversely in relation to the upper 2, 12, and vertically in two positions which adjust the level of support it gives by being reversed 180° on itself, but also in two other positions by virtue of angular mounting at 90°. This arrangement proves advantageous if one desires more than two positions of adjustment of the level of support provided by the plate 38, even if the latter comprises only two areas 48, 49 of differing flexibilities. In fact, in accordance with the example in question, in which the plate 38 incorporates a fairly rigid area 48 and a flexible area 49, firm support can be achieved by causing the area 48 to extend beyond the upper edge of the upper 2, 12; more flexible support by reversing the plate 38 by 180°, thereby positioning the area 49 near this edge of the upper; or again, two support levels possessing "mixed" flexibility, by positioning the plate 38 90° to these preceding positions, since, in this case, a portion of each area 48 and 49 extends beyond this edge of one side or the other, depending on the direction of rotation of this plate in relation to its initial mounted position.

FIG. 8 illustrates an embodiment of the attachment means 9, whose tenons 10 are located on the support plate 58, while the hollow elements 11 are made in the wall of the upper 2, 12.

According to a variant illustrated in FIG. 9, the means for fastening the plate 68 are reduced simply to two tenons 10 located on the boot upper (not shown) and three hollow elements 11 aligned and spaced apart by a value "a" similar to the value separating the tenons 10. In this case, the embodiment nevertheless yields two lateral or vertical adjustment positions, depending on the direction of arrangement of the tenons 10 in relation to the boot upper, and two positions of adjustment of the level of support given by the plate.

Of course, the support plate-attachment means may be formed from elements other than tenons, and, in particular, by the cylindrical shafts of conventional assembly pieces, such as screws, bolts, pins, etc., which are preferably removable, but which can include parts that can be removed by destroying them and that can be replaced on demand, e.g., rivets.

Moreover, not only can the support plate comprise at least two areas of differing flexibilities, but it can made with an elastically compressible part.

Finally, the support plate is not limited to use on the front part of the boot upper. but can be fastened at any point near the edge of the entry perimeter of this upper, whether at the rear and/or on the sides.

What is claimed is:

1. A sport shoe comprising a shell surmounted by an upper, fitted on the inner wall near its foot-insertion perimeter, with a support plate incorporating two areas of differing flexibilities, said support plate being angularly adjustable using means ensuring its attachment to the upper between at least two opposite angular positions separated by 180°, each of which corresponds to the utilization of one of the flexible areas, wherein the means for attachment of the support plate comprise at least two tenons cooperating with an equal number of slots the support plate thus being immobilized in rotation and its angular adjustment being dependent on the retraction of said tenons from said slots, then on the reinsertion of the tenons into slots matched up with them, wherein the number of slots is greater than the number of tenons and said slots are spaced apart by a distance (a) equal to that separating said tenons, the support plate thus being adjustable "slot by slot" in relation to the upper, in addition to the angular adjustment thereof.

2. The sport shoe according to claim 1, wherein said slots are parallel and oblong, and the tenons are cylindrical parts having a diameter adjusted to fit the length of said slots, the support plate being adjustable continuously in relation to the upper as a function of the length of the slots.

3. The sport boot according to claim 1, wherein the tenons are formed by cylindrical shafts of removable assembly parts.

4. The sport boot according to claim 1, wherein the areas of differing flexibilities of the support plate are created by weakening notches made in at least one of said areas.

5. The sport boot according to claim 1, wherein the areas of differing flexibilities of the support plate are produced by using at least two distinct materials, one being more flexible than the other.

6. The sport boot according to claim 1, wherein the more flexible material is also elastically compressible.

7. The sport boot according to claim 1, wherein there are two areas of differing flexibilities located substantially on either side of the means used to attach the support plate.

8. The sport boot according to claim 1, wherein the upper of the shoe is collar-shaped and is closed by overlapping transverse flaps and wherein the support plate is attached to at least one of the flaps.

9. The sport boot according to claim 1, wherein the boot upper incorporates a front cover and a rear cover which can be attached using a closing device, and wherein the support plate is fastened to at least one of said covers.

* * * * *